US005135013A

United States Patent [19]

DePaolo

[11] Patent Number: 5,135,013

[45] Date of Patent: Aug. 4, 1992

[54] METHOD OF USING A HAIR SPRAY FACE SHIELD

[76] Inventor: Vincent J. DePaolo, 10555 Turtlewood, No. 512, Houston, Tex. 77072

[21] Appl. No.: 678,447

[22] Filed: Apr. 1, 1991

[51] Int. Cl.[5] ..... A45D 40/30

[52] U.S. Cl. ..... 132/319; 132/212

[58] Field of Search ..... 132/212, 319, 333; 2/9, 174

[56] References Cited

U.S. PATENT DOCUMENTS

| | | | |
|---|---|---|---|
| D. 225,910 | 1/1973 | Kurianski | 2/9 |
| 1,492,196 | 4/1924 | Bergstrom | 132/333 |
| 3,060,445 | 10/1962 | Brockman | 2/9 |
| 3,328,806 | 7/1967 | Allegro | 2/9 |
| 3,963,034 | 6/1976 | Runberg et al. | 132/212 |
| 4,396,027 | 8/1983 | Loewenstine | 132/212 |
| 4,837,861 | 6/1989 | Cole | 2/9 |

FOREIGN PATENT DOCUMENTS

| | | | |
|---|---|---|---|
| 1003412 | 2/1957 | Fed. Rep. of Germany | 2/9 |
| 2013772 | 12/1971 | Fed. Rep. of Germany | 132/319 |
| 2210832 | 10/1973 | Fed. Rep. of Germany | 132/319 |
| 891130 | 3/1962 | United Kingdom | 132/212 |

*Primary Examiner*—Gene Mancene
*Assistant Examiner*—Frank A. LaViola
*Attorney, Agent, or Firm*—Kenneth A. Roddy

[57] ABSTRACT

A face shield for protecting a person's face from hair spray and the like has a sheet of thin flexible transparent material of planar generally quadrilateral shape which is of sufficient dimension to cover the face of a user and an elongate narrow rectangular support handle which is secured vertically to the sheet intermediate the side edges thereof and extends a distance above and below the bottom edge of the sheet. The handle is of sufficient rigidity to strengthen the sheet in a vertical plane to prevent it from bending about a horizontal axis. The sheet is sufficiently thin such that it may be selectively cut by a scissors or similar implement to substantially fit and provide adequate protection for various facial shapes and sizes and to provide a top edge to closely conform to the shape of the hair line of the user. Holding the lower portion of the handle, the sheet is placed in front of the face with the handle positioned over the nose such that the person over which the shield is placed has an unobstructed view of the hair.

1 Claim, 1 Drawing Sheet

METHOD OF USING A HAIR SPRAY FACE SHIELD

BACKGROUND OF THE INVENTION

1. Field of the Invention

This invention relates generally to face shields, and more particularly to a thin flexible transparent plastic shield for protecting the eyes, nose and mouth of the user from hair spray and aerosol dispensed chemicals.

2. Brief Description of the Prior Art

Cosmetic preparations, particularly hair sprays are dispensed from aerosol containers. Many of chemicals and aerosol discharging agents are harmful, irritating, and/or uncomfortable to the skin, eyes, and respiratory system of the user. Face shields have been developed to protect the user while applying sprays. However, most have not been widely accepted because they are expensive, inconvenient to use, or do not provide adequate protection or visibility. There are several patents which disclose face shields of various construction.

Kurianski, U.S. Pat. Des. No. 225,910 discloses a generally rectangular concave facial shield.

Dobey, U.S. Pat, No. 1,319,273, and Campbell, U.S. Pat. No. 3,038,470 each disclose a facial masks with bendable wire frames which cover the nose and mouth of the user and support a gauze fabric or tissue.

Bergstrom, U.S. Pat. No. 1,492,196 discloses a powder shield composed of a wire frame on which a shield sheet can be mounted and a handle for supporting the frame. The wire frame has concave curve at the top to conform to the neck of the user and shoulder shielding portions on opposite sides of the curved portion. The shield is held against the neck to prevent face powder from coming into contact with the clothes of the user.

Alosi et al, U.S. Pat. No. 3,772,707 discloses a facial hair spray shield having a plastic sheet connected to a resilient handle. Squeezing the handle flexes the sheet against the sides of the face of the user.

Runberg, U.S. Pat. No. 3,963,034 discloses a make-up guard in the form of a flat sheet which may be wrapped around an aerosol container and has score lines which cause the sheet to assume a paddle-like configuration when the handle edges are squeezed together.

Cole, U.S. Pat. No. 4,837,861 discloses a molded cup-shaped, paddle-like facial spray guard of rigid material which has a mirror attached to the concave side of the guard.

The present invention is distinguished over the prior art in general, and these patents in particular by a face shield for protecting a person's face from hair spray and the like having a sheet of thin flexible transparent material of planar generally quadrilateral shape which is of sufficient dimension to cover the face of a user and an elongate narrow rectangular support handle which is secured vertically to the sheet intermediate the side edges thereof and extends a distance above and below the bottom edge of the sheet. The handle is of sufficient rigidity to strengthen the sheet in a vertical plane to prevent it from bending about a horizontal axis. The sheet is sufficiently thin such that it may be selectively cut by a scissors or similar implement to substantially fit and provide adequate protection for various facial shapes and sizes and to provide a top edge to closely conform to the shape of the hair line of the user. Holding the lower portion of the handle, the sheet is placed in front of the face with the handle positioned over the nose such that the person over which the shield is placed has an unobstructed view of the hair.

SUMMARY OF THE INVENTION

It is therefore an object of the present invention to provide a face shield which provides protection for the eyes, nose, and mouth of the user when applying hair sprays and other aerosol chemicals.

It is another object of this invention to provide a face shield which allows the user a clear view of his face and hair when applying hair sprays and other aerosol chemicals.

Another object of this invention is to provide a face shield which may easily be cut with a pair of scissors to custom fit the shield to the size and shape of the user's face and hair line.

Another object of this invention is to provide a face shield which is easy to use.

A further object of this invention is to provide a face shield which is disposable.

A still further object of this invention is to provide a face shield which is simple in construction and economical to manufacture.

Other objects of the invention will become apparent from time to time throughout the specification and claims as hereinafter related.

The above noted objects and other objects of the invention are accomplished by a face shield for protecting a person's face from hair spray and the like having a sheet of thin flexible transparent material of planar generally quadrilateral shape which is of sufficient dimension to cover the face of a user and an elongate narrow rectangular support handle which is secured vertically to the sheet intermediate the side edges thereof and extends a distance above and below the bottom edge of the sheet. The handle is of sufficient rigidity to strengthen the sheet in a vertical plane to prevent it from bending about a horizontal axis. The sheet is sufficiently thin such that it may be selectively cut by a scissors or similar implement to substantially fit and provide adequate protection for various facial shapes and sizes and to provide a top edge to closely conform to the shape of the hair line of the user. Holding the lower portion of the handle, the sheet is placed in front of the face with the handle positioned over the nose such that the person over which the shield is placed has an unobstructed view of the hair.

DESCRIPTION OF THE PREFERRED EMBODIMENT

Figure 1:
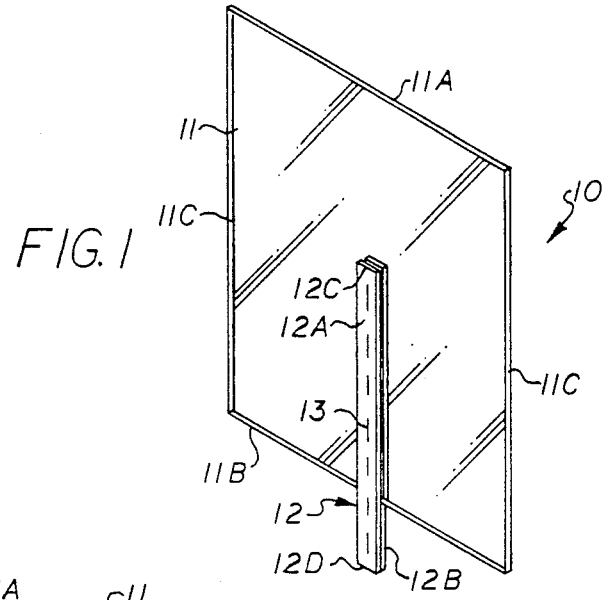
FIG. 1 is an isometric view of a preferred face shield in accordance with the present invention.
Figure 2:
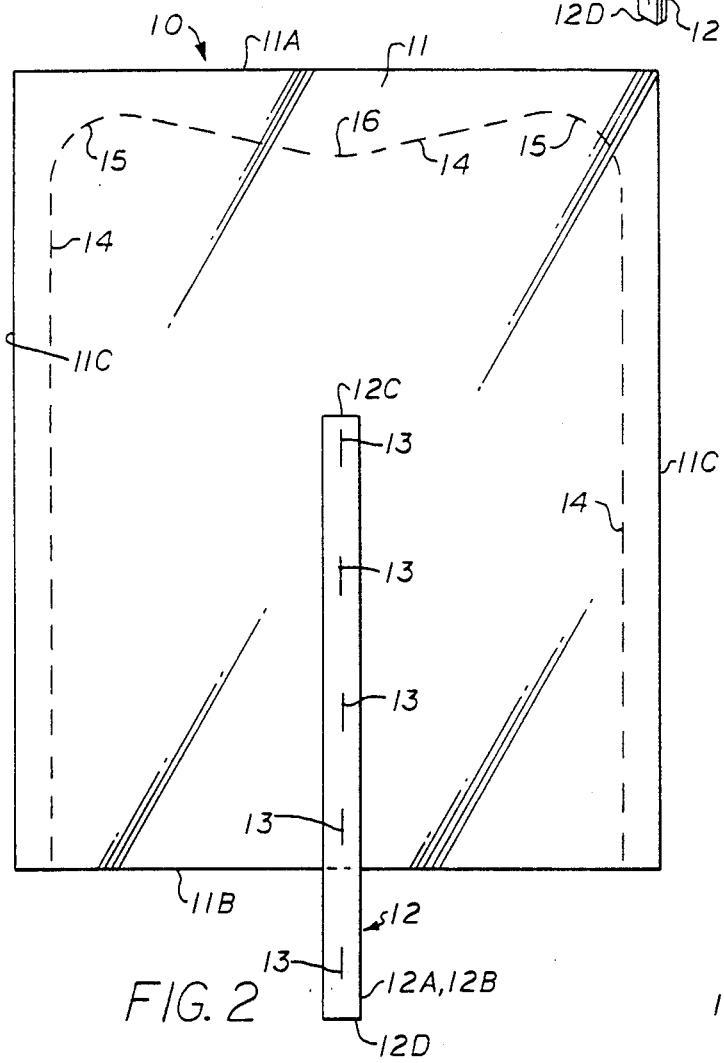
FIG. 2 is a front elevation of the face shield of FIG. 1 with dashed lines to represent cutting the shield to size.
Figure 3:
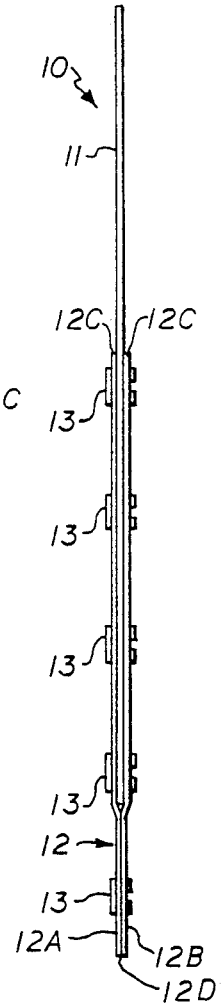
FIG. 3 is a side elevation of the face shield.

Referring to the drawings by numerals of reference, there is shown in FIGS. 1, 2, and 3, a preferred face shield 10. The face shield 10 is constructed of a transparent sheet 11 with a handle 12 secured thereto. The preferred sheet 11 is formed of thin, transparent, flexible material, such as cellulose acetate. The sheet 11 is generally square or rectangular having opposed parallel top and bottom edges 11A and 11B, respectively, and opposed parallel side edges 11C.

Figure 4:
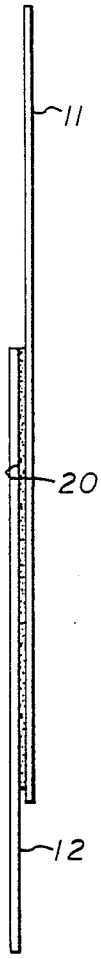
FIG. 4 is a side elevation of the face shield showing an alternate handle attachment.

The handle 12 is formed of a pair of narrow elongate rectangular strips 12A and 12B of rigid or semi-rigid material, such as polyethylene or other suitable inexpensive material. The strips 12A and 12B are secured to the front and back surfaces of the sheet in superposed relation by means of staples 13 or other suitable fastening means such as adhesive. As shown in FIG. 4, the handle 12 may also be a single narrow elongate strip of material secured to only one side of the sheet 11 by adhesive 20 or other suitable means.

The strips 12A and 12B of the handle 12 are secured vertically at the center of the sheet 11 between the side edges 11C and parallel thereto with their top end 13A positioned more than half the length of the sheet 11 above the bottom edge 11B, or in other words, less than halfway down from the top edge 11A. Thus, the strips 12A and 12B add strength and rigidity to the thin sheet 11 along the vertical plane to prevent the sheet from bending about a horizontal axis. The bottom end 13B of the handle strips 12A and 12B extend below the bottom edge 11B of the sheet 11 a distance to provide a suitable grip by the hand of the user.

As represented by dashed lines 14 in FIG. 2, the sheet 11 may be cut by a pair of common household scissors to conform to the shape and size of the user's face and hair line. For example, the sides of the sheet 11 may be cut as represented by lines 14 to make the sheet narrower, and the top edge of the sheet may be cut to have rounded corners 15 and the top surface may be contoured 16 to conform with the hair line of the user.

Thus, the present face shield can be customized to fit and provide adequate protection for virtually any facial shape and size and to provide a close fit conforming to the shape of the hair line of the user.

In use, the face shield 10 is held by the lower portion of the handle 12 and the sheet portion 11 is placed in front of the face of the user with the handle 12 over the nose. The user then has an unobstructed view of the hair and can safely spray the hair spray as desired. The sheet 11 will prevent any spray particles from direct contact with the eyes, nose, mouth, and facial skin of the user.

The face shield 10 may be used repeatedly or may be discarded after use because of its simple construction and inexpensive materials.

In commercial establishments, the face shield 10 may be cut by the hairdresser to fit the face of a patron, and then after the spray has been applied, presented to the patron as a gift for home use. This provides an element of enjoyment to the patron and a reminder of the care and personal attention given by the commercial establishment.

While this invention has been described fully and completely with special emphasis upon a preferred embodiment, it should be understood that within the scope of the appended claims the invention may be practiced otherwise than as specifically described herein.

I claim:

1. A method of protecting a person's eyes, nose, mouth and facial skin from particles of hair spray comprising the steps of;

providing a cut-to-fit face shield having a sheet of thin flat flexible transparent material of quadrilateral shape with opposed parallel top and bottom edges and opposed parallel side edges and of sufficient dimension to cover the face of a user and an elongate narrow rectangular handle centered parallel to said sheet side edges and extending a distance below the bottom edge thereof to receive the hand of a user and said handle having a top end positioned more than half the length of said sheet above the bottom edge thereof to strengthen said sheet along a vertical plane to prevent it from bending about a horizontal axis, cutting said sheet with a scissors to substantially fit the periphery of face of the user for providing adequate protection and cutting the top edge of said sheet to closely conform to the shape of the hair line of the user, holding the lower portion of said handle and placing said sheet in front of the face of the user with said handle positioned over the nose of the user such that the user has an unobstructed view of the hair, and spraying a hair spray chemical onto the hair of the person over which the face shield is positioned.

* * * * *